United States Patent [19]

Weilow

[11] Patent Number: 4,621,938

[45] Date of Patent: Nov. 11, 1986

[54] JOINT

[75] Inventor: Gerth Weilow, Södertälje, Sweden

[73] Assignee: Hennix i Stockholm AB, Sundbyberg, Sweden

[21] Appl. No.: 829,132

[22] PCT Filed: Apr. 16, 1985

[86] PCT No.: PCT/SE85/00175

§ 371 Date: Dec. 13, 1985

§ 102(e) Date: Dec. 13, 1985

[87] PCT Pub. No.: WO85/04921

PCT Pub. Date: Nov. 7, 1985

[30] Foreign Application Priority Data

Apr. 17, 1984 [SE] Sweden ..... 8402143

[51] Int. Cl.[4] ..... E04B 1/24; E04B 1/58; F16B 12/42; A47B 96/14

[52] U.S. Cl. ..... 403/217; 52/280; 52/648; 52/654; 52/656; 211/182; 211/191; 211/207; 211/208; 403/172; 403/173; 403/218

[58] Field of Search ..... 211/182, 191, 207, 208; 403/172, 173, 218; 52/280, 236.7, 654, 648, 656

[56] References Cited

U.S. PATENT DOCUMENTS

| | | | |
|---|---|---|---|
| 563,529 | 7/1896 | Wilson | 403/173 |
| 1,581,487 | 4/1926 | Kohler | 52/648 |
| 2,159,666 | 5/1939 | Lotz | 52/656 X |
| 2,653,060 | 9/1953 | Rubenstein | 403/217 |
| 2,748,954 | 6/1956 | Murren | 211/182 X |
| 3,097,730 | 7/1963 | Halle | 403/173 |
| 3,513,606 | 5/1970 | Jones | 52/648 X |
| 3,747,965 | 7/1973 | Wing | 403/173 |
| 3,837,754 | 9/1974 | Malcik | 403/217 |
| 4,534,473 | 8/1985 | Post | 211/207 X |

FOREIGN PATENT DOCUMENTS

| | | | |
|---|---|---|---|
| 1484277 | 4/1970 | Fed. Rep. of Germany | 211/182 |
| 2645834 | 11/1977 | Fed. Rep. of Germany | 403/172 |
| 462418 | 10/1968 | Switzerland | 52/236.7 |

*Primary Examiner*—Alfred C. Perham

*Attorney, Agent, or Firm*—Burns, Doane, Swecker & Mathis

[57] ABSTRACT

A joint between a vertically oriented hollow section column (1) and a horizontal load-carrying beam (3) in a two-story building structure such as an exhibition stand, which can be rapidly erected and dismantled, includes a straight core (2) fitted into the upper end of the column (1). The quadratic hollow section core (2) has a projecting bolt head (21) at the middle of either side surface. Each side wall of the generally quadratic hollow section column (1) has a central, axial slot (12) on its inside. On its underside the beam carries a dependent guide body, the width of which corresponds to the width of the internal column slot and is guided by this slot. The short end of the beam (3) has a vertically directed Tee slot (32,36) extending upwardly from the central area of the beam for accommodating the head and a portion of the shank of the screw on the core (2). A screening element (10) may be formed from the same section as the column (1) and is placed against the portion of the core (2) exposed along the height of the beam (3).

10 Claims, 6 Drawing Figures

Fig. 1
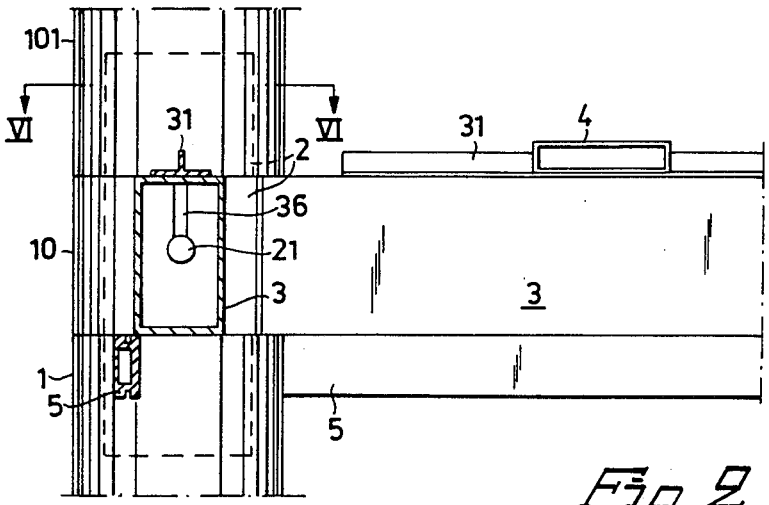
Fig. 2
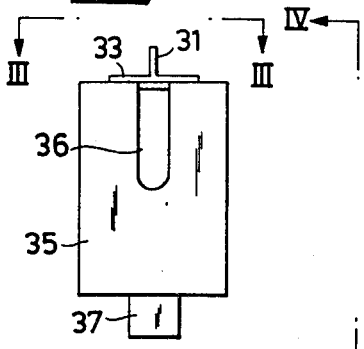
Fig. 3
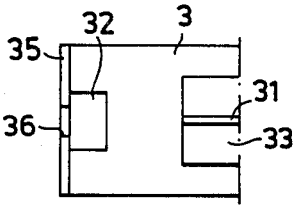
Fig. 4
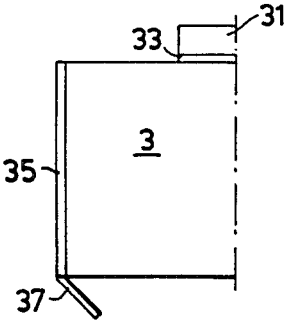
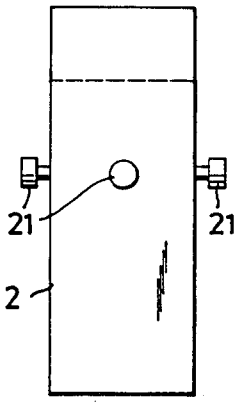
Fig. 5

JOINT

TECHNICAL FIELD

The invention relates to a joint between a vertically oriented hollow section column and a horizontal beam carrying a structural floor in a two-storey building construction such as an exhibition stand, which can be rapidly erected or dismantled, where the joint includes a straight core which is fitted into the upper end of the column and has a screw, the head of which engages with the beam.

BACKGROUND ART

In recent times, exhibition stands have begun to be built in two storeys. There is a strong desire that such exhibition stands can be erected or dismantled in a short time and also that they can be reused. This puts large demands on the structure. The load-carrying parts of it shall not only meet strength requirements but must also have low weight and afford simple, multiple fixing possibilities for shelves, screens, panels etc., and it is furthermore a strong desire that the structure will have a tastefully pleasing appearance.

A further requirement is that the structure shall be fixible in as far as it will afford a modular system giving the availability to great variation of the size and configuration of the structure with the use of a few components.

A structure in the prior art includes hollow section columns which are erected and mutually braced, a straight core being fitted into the upper end of each column. The core is provided with exterior screws and the beams have keyhole openings on their side surfaces. The beams are connected by their keyhole openings to the screws of the core and rest on the upper edge of the column. Each column must therefore carry two beams, one on either side of the core. This means that the variations in configuration and flexibility of the structure are limited, that the core must have a flange resting on the upper end of the column and that flooring boards must be laid with their longitudinal direction at right angles to the direction of the pair of carrying beams. There is also the problem that the flooring boarding must be fixed to the carrying beams, and in a modular system with the availability of extension, there will be gaps between the floor boards between the pair of carrying beams.

Furthermore, the joint between beams and column will be exposed above the upper end of the column, which does not give a pleasing impression, added to which it will be difficult to connect wall panels, forming wall surfaces in the structure, between the columns in the region of the beams.

One object of the invention is therefore to provide a joint between a vertical column and a horizontal beam in a structure of the kind mentioned in the introduction, this joint entirely or partially satisfying the mentioned desires, while solving or reducing at least some of the problems mentioned above, as well as offering advantages which have already been mentioned or which will be understood by one skilled in the art.

CHARACTERIZATION OF THE INVENTION

A joint between a vertically oriented, generally quadratic hollow section column and a horizontal beam carrying a structural floor in a building structure such as an exhibition stand, which can be rapidly erected and dismantled, includes a straight core which is fitted into the upper end of the column and has a bolt, the head of which engages against the beam, and is essentially distinguished in that the side walls of the column each have on their insides a central, axial slot, in that the beam at its connection end has a guide body dependent from its lower surface, the width of the body substantially corresponding to the width of the internal slot in the column, and the length of the body in the direction of the beam being less than the depth of the column slot, in that the beam has its lower surface bearing against the upper end of the column with its end surface abutting the core, the axis of the beam intersecting the axis of the column, and in that the short end of the beam has a vertically directed Tee slot extending upwardly from the central area of the beam and through the upper surface of the beam, whereby the beam may be fixed to the column by being placed on the upper edge of the column with the body in the slot in the column, whereafter the core is thrust down into the cavity in the column so that its screw head is thrust into the Tee slot in the beam end, whereafter an optional further column can be pushed over the part of the core projecting above the beam.

Preferred embodiments of the invention are apparent from the claims 2–6.

The columns are suitably symmetrical in relation to two mutually right-angular axes cutting the longitudinal axis of the column. The columns are suitably cut square. On the outside of the column there are suitably two undercut slots or flutings along each side in the vicinity of the corners of the column, which has its corners bevelled and provided with longitudinal undercut slots or flutings. These undercut fluting serve as attachment means for shelves, rails, panels, screens, etc, and are conventional per se.

Apart from a central, longitudinal slot on each inside surface of the hollow section, there are four corner guides for the core on the inside of the column. The projecting screws of the core may be fixed and do not usually need to be adjusted. The core screws are in a plane normal to the core axis and are in the central point of each side of the core, which is preferably a simple quadratic hollow section.

The beam is also suitably a hollow section, at its end provided with a welded-on end plate having a projecting tongue which is bent to form the mentioned body. The end plate has a slot extending centrally from approximately half the height of the beam and upwards, there being a cutout at the upper side of the beam at its end for permitting free entry and exit of the screw head to and from the Tee slot formed by the slot in the plate and the cutout.

In an exhibition stand of the kind mentioned, the walls or balustrades are erected from the upper floor. The balusters or wall studs are formed from the same hollow section as the mentioned column, and may be readily connected to the core by simply being thrust down over the upstanding end of the core. In the case where no such wall stud or baluster is to be erected, the core should be arranged so that its upper end is flush with the upper surface of the floor boarding.

On their upper surfaces the beams are preferably provided with a central, upstanding longitudinal flange. This flange serves to prevent lengthwise displacement of floor boarding mounted on the carrying columns. It will be understood that by the inventive joint there is obtained a structure which, when the columns are located at the corners of a quadrangle, allows optional laying direction for the floor boarding. It will be further understood that in an exhibition stand built up from several modular units, the floor boarding can be laid with its ends substantially adjacent each other, only being separated by the described flange. The flange may also be provided by using a T-section symmetrically attached to the upper side of the beam. The flange height is less than the height of the floor boarding. In turn, the floor boarding may also comprise conventional hollow sections. All the sections mentioned are suitably extrusions from a light metal alloy, such as aluminium.

The gap between the upper end of the lower column and the lower end of the column part above can be simply and tastefully screened in the following manner. Assume that two beams are connected at a mutual angle of 90° to a column. An element may then be cut from a column section, the length of the element corresponding to the height of the corresponding beam. The walls of the element are cut away in positions corresponding to the side surfaces facing away from each other of the two beams. The remaining major portions of the piece can then be easily pushed over the core and its screws, after which the upper column part is put in place on the core. The column section also preferably has two axial slots associated with each side surface and parallel to it, the depth of each slot extending away from the slot receiving said beam body. In the case where the screening element is not attached to the core by its own shape, it may be provided with a guide plate inserted in the two axial grooves and projecting out from the screening piece. These plates can then be taken down into the corresponding slots in the column and the element is thus kept in place.

The floor boards adjacent a column can be cut away at one corner for fitting snugly to the column. The external flutings on the side surface of the hollow section allow conventional connection of bracing, which is preferably and conventionally provided with longitudinal grooves on its upper and lower side. These grooves are arranged to be just outside the side surfaces of the carrying beams, and allow the reception of panels which can thus extend parallel to, and adjacent the side surfaces of the carrying beams. The bracing and other extra equipment are connected to the exterior flutes of the hollow section column with conventional expansion means.

The invention will now be described in detail with the aid of an illustrative embodiment and with reference to the accompanying drawing.

DRAWING

FIG. 1 schematically illustrative a joint in accordance with the invention.

FIG. 2 is an end view of the carrying beam.

FIG. 3 is a section along the line III—III in FIG. 2.

FIG. 4 is a section along the line IV—IV in FIG. 2.

Figure 6:
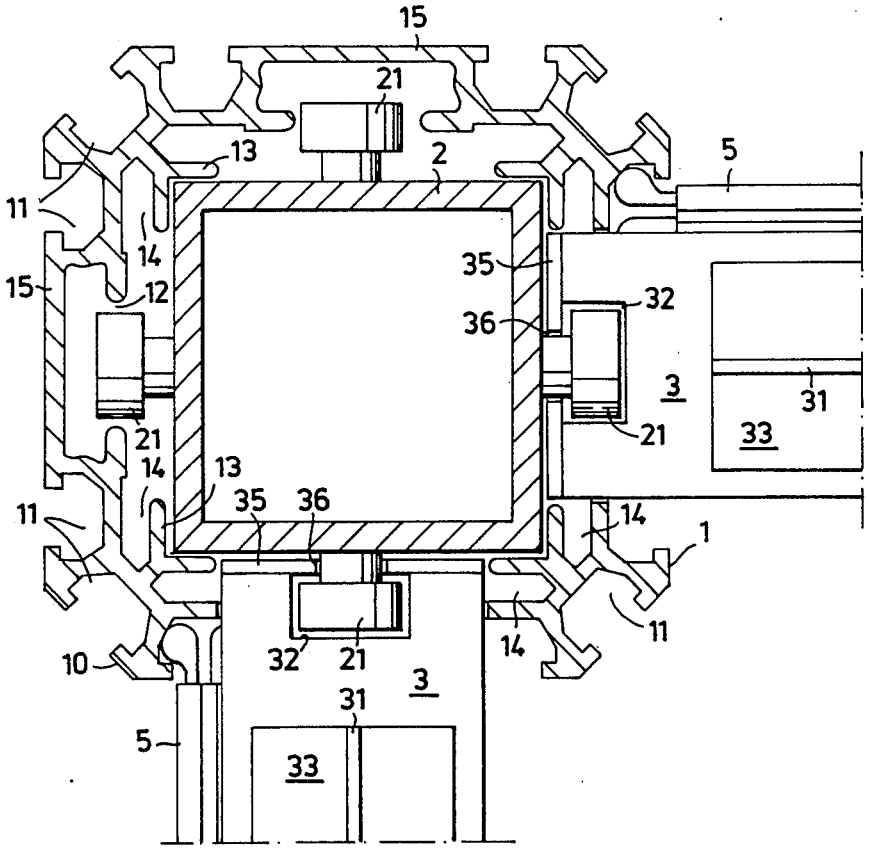

FIG. 5 schematically illustrates a core included in the joint.

FIG. 6 is a section along the line VI—VI in FIG. 1.

ILLUSTRATIVE EMBODIMENT

A joint in accordance with the invention is illustrated in FIGS. 1 and 6, between a vertically oriented fluted hollow section column 1 and two horizontal carrying beams 3, carrying filter joists or sections 4 (of which only one is shown) which forms a covering structural floor in a two-story exhibition stand. The column 1 is exteriorly fluted and generally quadratic, and the stand is built up in right-angular modules. It may be assumed that at least four columns 1 are erected at the corners of a pre-determined quadrangle or rectangle, and that the columns 1 are mutually braced with ties 5. The beams 3 are placed on the square-cut upper end of the column 1, and are suitable rectangular hollow sections. As will be seen in FIG. 6, the section 1 has a central, axial slot 12 on each of its inside surfaces. As is apparent from FIGS. 2–4 the connection end of the beam 3 has a welded-on cover plate 35, having a dependent bent tongue 37. The tongue 37 has a width corresponding to the slot 12 in the corresponding column 1 and is located symmetrically on the beam 3. On its inside the column 1 also has corner guides 13 for a core 2 which can be fitted into the column 1. The depth of the slot 12 can be reckoned from the outside of the core 2, as will be seen from FIG. 6.

The tongue 37 is arranged to extend in the longitudinal direction of the beam 3 from the cover plate 35 a distance less than the depth of the column slot 12.

When the beam 3 is fixed to the column 1, the tongue 37 is inserted in the slot 12 so that the axis of the beam 3 cuts the axis of the core 2 and column 1.

Returning to FIGS. 2–4, it will be seen that the cover plate 35 has a slot 36 extending from half the beam height and upwards. There is further a central cutout 32 arranged in the upper wall of the beam 3. The opening 32 and slot 36 form a Tee slot receiving a screw 21, which is fastened to the core tube 2.

After the beams 3 have been placed on the column 1, the core 2 is thrust down into the upper end of the column 1, the screws 21 being accommodated in the beams 3 via the Tee slots. The cover plates 35 will thus carry the core 2. The beams 3 are now well connected to the column 1 by the screws 21 restraining the beams 3 in a horizontal direction. Furthermore, the screws 21 prevent the beams from tipping.

A baluster or a further column 101 can now be easily placed over the upstanding end of the core 2.

On its upper side each beam 3 is provided with a centrally arranged T section 33, the leg 31 of which is upstanding in the symmetrical plane of the beam 3. The leg 31 forms an end stop for floor boards 4 so that they are not displaceable in their longitudinal direction.

In the case where no baluster 101 or the like is to be erected over the column 1, the core 2 is arranged with such a length above the screws 21 that the upper end of the core 2 is flush with the upper surface of the floor boards 4. If a baluster 101 having a cross section corresponding to that of the column is to be erected on the upstanding end of the core 2, the upstanding end should be extended so that it projects above the floor boards 4.

A screening element 10 is arranged in the gap between the upper end of the column 1 and the lower end of the baluster section 101. The screening element 10 is made from the same section as the column 1 and has a length corresponding to the distance between the column 1 and the baluster 101 or the upper side of the beam 3. The walls of the element are cut away axially in positions corresponding to the surfaces facing away from each other on the beams 3 (see FIG. 6). The free screws 21 of the core 2 are received in the slot 12 of the element 10.

Assuming now that two beams 3 are to be connected to opposing sides of the core tube, the screening element will substantially only include one side of the column section 1, and fastening means are required to retain the screening element. Such retaining means may be formed by simple plates inserted in slots 14 which are associated with each side surface and parallel to it, the depth of each slot extending away from the slot 12, the inner walls of the slots being the outer walls of the guides 13 for the core 2. Such plates may then be mounted in the slots 14 on the screening elements so that they project axially out from the screening element, which may thus be fastened to the upper end of the column, and optionally in a corresponding manner to the baluster 101 when such is used. The column section 1 has undercut flutes 11 on its outside, which allow the connection to the column of ties 5 and other objects with the aid of conventional expansion means.

To advantage, the beams 3 are made with standard lengths, e.g. three standard lengths, and the horizontal ties 5 can also be made in three standard lengths. Large variation is thus afforded for stand construction with a minimum number of beams and ties.

As will be seen from FIG. 6, the horizontal tie 5 is provided with grooves on its upper and lower sides, these groves being intended to receive such as panels which may thus be arranged to cover the side surfaces of the beam 3. The mutual spacing between the grooves 11 on a side surface of the column 1 is thus well adjusted to the width of the beam 3 to afford said erection of panels.

The screws 21 may be rigidly attached to the core 2 and do not need to be adjusted with relation to the distance from the bolt head to the outside wall of the core 2. The joint may thus easily be fixed by the end of the beam 3 being placed on the stabilized vertical column 1 so that the tongue 37 of the beam engages in the slot 12 of the column 1, the core 2 then being thrust into the upper end of the column 1 so that the screw 21 of the core is thrust down into the Tee slot in the beam end, an optional screening element 10 then being mounted on the core 2, and optional balusters 101 with the same section as the column 1 may be thrust over the upstanding part of the core 2.

Since the section of the column 1 is essentially quadratic, and the beams 3 are connected with their axes intersecting the axis of the column 1, the spacing between parallel beams in a quadratic stand section will be just as great in either direction, and thus the floor boards 4 can be laid between either pair of parallel beams 3 and the flange 31 of the beams 3 will prevent axial displacement of the boards 4.

I claim:

1. A joint between a vertically oriented hollow section column (1) and a horizontal beam (3) carrying structural flooring in a two-storey building structure, such as an exhibition stand which can be rapidly erected and dismantled, the joint including a straight quadratic core (2) which is fitted into the upper end of the generally quadratic hollow section column (1) and which has a screw (21), the head of which engages with the beam, characterized in that the side walls of the column (1) each have on their insides a central, axial slot (12), that the beam (3) at its connection end has a central guide body dependent from its lower surface, the width of the body substantially corresponding to the width of the internal slot (12) of the column (1) and the length of which in the direction of the beam is less than the depth of the column slot (12) so that the body (37) is accommodated in the slot (12) when the beam end engages against the side surface of the core (2), in that the beam (3) has its lower surface bearing against the upper square cut end of the column (1), with the end surface of the beam abutting the core, the axis of the beam intersecting the axis of the column (1) and in that the short end of the beam (3) has a vertically directed Tee slot (32,36) extending upwardly from the central area of the beam (3) and through the upper surface of the beam, whereby the beam may be fixed to the column (1) by the beam being placed on the upper edge of the column with the body (37) in the internal central slot (12) of the column, whereafter the core (2) is thrust down into the column so that the screw head on the core is taken down into the Tee slot (32,36) of the beam end, whereafter an optional, further column (101) can be placed over the end of the core (2) upstanding above the beam (3).

2. A joint as claimed in claim 1, characterized in that the beam (3) is a hollow section, to the end of which there is welded a cover plate (5), having a dependent, bent tongue (37) forming said body, the plate (35) having a central slot with a width corresponding to the shank dimension of the bolt, the slot extending upwards from the middle of the beam, there also being an opening (32) arranged in the upper wall of the beam (3) in conjunction with the slot (36), said opening accommodating the head of the screw on the core (2) and forming said Tee slot.

3. A joint as claimed in claim 2, characterized in that the joint includes at least two beams (3) which are connected to the column (1), a screening element (10) made from a piece of the same section as the column (1) being axially cut in positions corresponding to the side walls of the beams (3) and disposed for covering the core between the side surfaces of the beams.

4. A joint as claimed in claim 3, characterized in that the beams (3) connected to the column (1) are axially in register with each other, and that the screening element substantially forms a continuation of the side walls of the column section (1), in that the section (1) has two slots (14) extending in the plane of the side wall and starting from either side of the central, internal slot (12) in the column walls, in that locking tongues are attached in the groove (14) in the screening element, starting from the central slot (12) and project axially outwards from the screening element for being thrust into the corresponding slots (14) in the column (1).

5. A joint as claimed in claim 2, characterized in that the section of the column (1) outwardly has axial, external slots and that two such external axial slots (11) are arranged on either side surface of the column (1) with a centre-to-centre spacing substantially corresponding to the width of the beam (3).

6. A joint as claimed in claim 1, characterized in that the joint includes at least two beams (3) which are connected to the column (1), a screening element (10) made from a piece of the same section as the column (1) being axially cut in positions corresponding to the side walls of the beams (3) and disposed for covering the core between the side surfaces of the beams.

7. A joint as claimed in claim 6, characterized in that the beams (3) connected to the columns (1) are axially in register with each other, and that the screening element substantially forms a continuation of the side walls of the column sections (1), in that the section (1) has two slots (14) extending in the plane of the side wall and starting from either side of the central, internal slot (12) in the column wall, in that locking tongues are attached in the groove (14) in the screening element, starting from the central slot (12) and project axially outwards from the screening element for being thrust into the corresponding slots (14) in the column (1).

8. A joint as claimed in claim 7, characterized in that the section of the column (1) outwardly has axial, external slots and that two such external slots (11) are arranged on either side surface of the column (1) with a centre-to-centre spacing substantially corresponding to the width of the beam (3).

9. A joint as claimed in claim 1, characterized in that the section of the column (1) outwardly has axial, external slots and that two such external axial slots (11) are arranged on either side surface of the column (1) with a centre-to-centre spacing substantially corresponding to the width of the beam (3).

10. A joint as claimed in claim 6, characterized in that the section of the column (1) outwardly has axial, external slots and that two such external slots (11) are arranged on either side surface of the column (1) with a centre-to-centre spacing substantially corresponding to the width of the beam (3).

* * * * *